US012104483B2

(12) United States Patent
Garcia et al.

(10) Patent No.: US 12,104,483 B2
(45) Date of Patent: Oct. 1, 2024

(54) AUTOMATIC DECK WRENCH ENGAGEMENT FOR DRILLING MACHINES

(71) Applicant: Caterpillar Global Mining Equipment LLC, Denison, TX (US)

(72) Inventors: Roberto Garcia, Sherman, TX (US); Charles Taylor Hudson, Sherman, TX (US); Yagneshwar Natarajan, Chennai (IN); Michael J. Kresca, Peoria, IL (US); Rex Aaron Glover, Deer Creek, IL (US)

(73) Assignee: Caterpillar Global Mining Equipment LLC, Denison, TX (US)

( * ) Notice: Subject to any disclaimer, the term of this patent is extended or adjusted under 35 U.S.C. 154(b) by 0 days.

(21) Appl. No.: 18/156,096

(22) Filed: Jan. 18, 2023

(65) Prior Publication Data

US 2024/0240552 A1 Jul. 18, 2024

(51) Int. Cl.

| | |
|---|---|
| ***E21B 44/00*** | (2006.01) |
| ***E21B 19/16*** | (2006.01) |
| ***E21B 47/013*** | (2012.01) |
| ***E21B 47/04*** | (2012.01) |

(52) U.S. Cl.

CPC ..... *E21B 47/013* (2020.05); *E21B 19/161* (2013.01); *E21B 44/00* (2013.01); *E21B 47/04* (2013.01)

(58) Field of Classification Search

CPC ..... E21B 47/013; E21B 19/161; E21B 44/00; E21B 47/04

See application file for complete search history.

(56) References Cited

U.S. PATENT DOCUMENTS

| | | | | |
|---|---|---|---|---|
| 5,133,576 | A | 7/1992 | Barnhill | |
| 5,358,058 | A * | 10/1994 | Edlund | E21B 7/025 73/152.43 |
| 5,465,798 | A | 11/1995 | Edlund et al. | |
| 5,653,297 | A | 8/1997 | Whisenhunt | |
| 6,298,926 | B1 | 10/2001 | Dalkert et al. | |
| 6,938,519 | B2 | 9/2005 | Boyd et al. | |
| 11,142,970 | B2 | 10/2021 | Gaska et al. | |

(Continued)

FOREIGN PATENT DOCUMENTS

| | | |
|---|---|---|
| WO | 2014133440 A2 | 9/2014 |
| WO | 2014134119 A2 | 9/2014 |

OTHER PUBLICATIONS

Written Opinion and International Search Report for Int'l. Patent Appln. No. PCT/US2024/010388, mailed Apr. 30, 2024 (10 pgs).

*Primary Examiner* — Taras P Bemko

(57) ABSTRACT

A controller may receive sensor data from one or more sensor devices of the drilling machine. The sensor data indicates a vertical position of a drilling assembly of the drilling machine. The drilling assembly includes a drill string connected to a drill bit. The controller may determine, based on the sensor data, that the vertical position of the drilling assembly corresponds to a deck wrench engaging position. The controller may cause a deck wrench, of the drilling machine, to engage an engagement portion of the drill string based on determining that the vertical position of the drilling assembly corresponds to the deck wrench engaging position. The engagement portion of the drill string is adjacent to an end of the drill string connected to the drill bit.

20 Claims, 5 Drawing Sheets

(56) References Cited

U.S. PATENT DOCUMENTS

| | | | | |
|---|---|---|---|---|
| 2003/0056989 | A1* | 3/2003 | Smith | E21B 19/167<br>175/122 |
| 2011/0219917 | A1 | 9/2011 | Connell | |
| 2016/0053602 | A1 | 2/2016 | Stacy, II et al. | |
| 2020/0131856 | A1* | 4/2020 | Shahid | E21B 7/022 |
| 2020/0308917 | A1* | 10/2020 | Diekmann | E21B 19/146 |
| 2020/0392800 | A1 | 12/2020 | Ramos et al. | |
| 2021/0277731 | A1 | 9/2021 | Moberg et al. | |

* cited by examiner

300

AUTOMATIC DECK WRENCH ENGAGEMENT FOR DRILLING MACHINES

TECHNICAL FIELD

The present disclosure relates generally to a deck wrench of a drilling machine and, for example, to the deck wrench automatically engaging a drill string of the drilling machine.

BACKGROUND

A drilling machine may be configured to perform a drilling operation using a drill bit connected to a drill string. During the drilling operation, the drill bit may be configured to drill holes into rocks or other similar material. The drill string may be actuated based on hydraulic fluid supplied to a hydraulic cylinder.

In some situations, the drilling machine may experience a condition during which the drill string drifts vertically toward a ground surface on which the machine is located. Drifting of the drill string may occur due to loss of hydraulic pressure (e.g., due to leakage of the hydraulic fluid supplied to the hydraulic cylinder), and/or due to air entrapment in the hydraulic fluid coupled with changes in fluid temperature.

Currently, the drill string is not supported during a tramming operation of the drilling machine from one location to another location. In some situations, the drifting of the drill string may occur during the tramming operation. The drifting of the drill string may be detected by the drilling machine during the tramming operation. Detecting the drifting of the drill string (during the tramming operation) may cause a tramming circuit of the drilling machine to detect a fault condition.

The fault condition may cause the drilling machine to automatically come to a halt. Accordingly, the drifting of the drill string may cause the drilling machine to automatically come to a halt when the drifting occurs during the tramming operation. Such a halt may cause unexpected and undesired downtime during the operation of the drilling machine. Additionally, such a halt may cause loss of efficiency with respect to an operation of the machine.

Furthermore, by not being supported during the tramming operation, the drill string may be subject to an undesired amount of vibration and/or to an undesired amount of gravitational force during the tramming operation. Additionally, by not being supported during the tramming operation, a mast structure (e.g., a mast and related components) of the drilling machine may be subject to the undesired amount of vibration and/or to the undesired amount of gravitation force during the tramming operation.

During the tramming operation, the mast structure may be in a vertical orientation or in a horizontal orientation. Subjecting the drill string and the mast structure to the undesired amount of vibration and/or to the undesired amount of gravitational force may cause premature wear and/or premature failure of the drill string and the mast structure.

International Patent Application Publication No. WO2014134119A2 (the '119 publication) discloses a deck wrench (of a drill rig) including a first arm having a first surface for engaging the drilling pipe. The '119 publication discloses that the deck wrench may include a first housing with the first arm slidingly disposed in the first housing to move from a first to a second position. The '119 publication further discloses that the deck wrench may include a first moving element attached to the housing and the first arm to move the first arm from the first to the second position, and the deck wrench may include a second arm having a second surface for engaging the drilling pipe.

The '119 publication discloses using the deck wrench to hold the drill pipe to assist in joining and separating the drill pipes. In other words, the '119 publication does not address issues related to protecting a drill string from drifting during a tramming operation of the drilling machine. Rather, the '119 publication is concerned with joining and separating drill pipes.

The deck wrench of the present disclosure solves one or more of the problems set forth above and/or other problems in the art.

SUMMARY

In some implementations, a system for controlling drilling operations includes one or more sensor devices configured to generate sensor data indicating a vertical position of a drilling assembly of a drilling machine, wherein the drilling assembly includes a drill string connected to a drill bit; and a controller, of the drilling machine, configured to: receive the sensor data; determine, based on the sensor data, that the vertical position of the drilling assembly corresponds to a deck wrench engaging position; and cause a deck wrench, of the drilling machine, to engage an engagement portion of the drill string based on determining that the vertical position of the drilling assembly corresponds to the deck wrench engaging position, wherein the engagement portion of the drill string is adjacent to an end of the drill string connected to the drill bit.

In some implementations, a method performed by a controller of a drilling machine includes receiving sensor data from one or more sensor devices of the drilling machine, wherein the sensor data indicates a vertical position of a drilling assembly of the drilling machine, and wherein the drilling assembly includes a drill string connected to a drill bit; determining, based on the sensor data, that the vertical position of the drilling assembly corresponds to a deck wrench engaging position; and causing a deck wrench, of the drilling machine, to engage an engagement portion of the drill string based on determining that the vertical position of the drilling assembly corresponds to the deck wrench engaging position, wherein the engagement portion of the drill string is adjacent to an end of the drill string connected to the drill bit.

In some implementations, a drilling machine includes a frame; a deck wrench supported by the frame; a mast supported by the frame; and a drill string supported by the mast, wherein the drill string includes an adapter configured to be connected to a drill bit, wherein the adapter includes a circumferential groove, and wherein the deck wrench is configured to engage the circumferential groove during a tramming operation of the machine.

DETAILED DESCRIPTION

Figure 1:
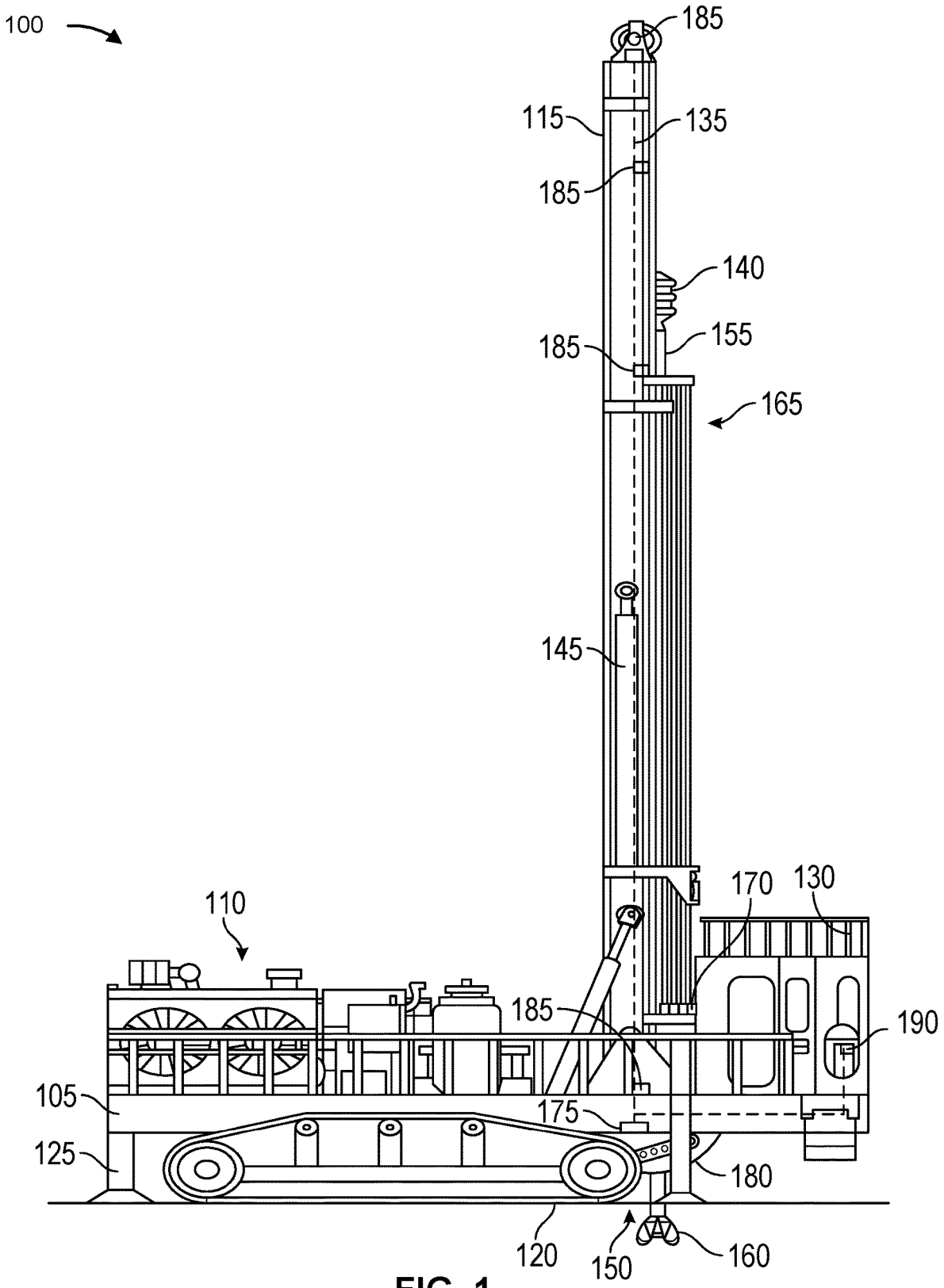
FIG. 1 is a diagram of an example machine described herein.

Implementations described are directed to preventing drifting of a drill string of a drilling machine during a tramming operation of the drilling machine. For example, implementations described herein are directed to causing a deck wrench of the drilling machine to extend and engage an engagement portion of the drill string. The deck wrench may be extended to engage the engagement portion after a drilling operation, at a first location, has been completed. In this regard, the deck wrench may be extended to engage the engagement portion during a tramming operation from the first location to a second location after the drilling operation has been completed.

The drill string may include a plurality of drill pipes. The plurality of drill pipes may include an adapter that is connected to a drill bit. The engagement portion may be adjacent to an end of the drill string (e.g., a bottom end of the drill string) connected to the drill bit. In other words, the engagement portion may be provided adjacent to an end of the adapter (e.g., a bottom surface of the adapter) that connects to the drill bit.

In some situations, the drill string may be retracted from away from a ground surface after a drilling operation. For instance, the drill string may be retracted in preparation for a tramming operation. When retracted in this manner, the drill bit may be considered to be in a stowed state (or in a stowed position). In some implementations, a location of the engagement portion may be based on the drill bit in the stowed state. For example, the location of the engagement portion may be based on a distance from the bottom surface of the adapter when the drill bit is the stowed state.

The engagement portion may include a circumferential groove. In some instances, a size of the circumferential groove may be based on a size of the deck wrench. A circular shape of the circumferential groove may facilitate the deck wrench engaging the engagement portion as opposed to a non-circular shape.

In some examples, the drilling machine may include a controller. The controller may be configured to detect whether the engagement portion is aligned with the deck wrench. Based on detecting that the engagement portion is aligned with the deck wrench and based on detecting that a drilling operation is completed, the controller may cause the deck wrench to engage the engagement portion.

By engaging the engagement portion of the drill string in this manner, implementations described herein may prevent the drill string from drifting toward the ground surface during the tramming operation after the drilling operation is completed. Additionally, by engaging the engagement portion of the drill string in this manner, implementations described herein may provide support to the drill string and to a mast of the drilling machine during the tramming operation. The mast may be in a horizontal orientation (or horizontal position) or may be in a vertical orientation (or vertical position).

The term "machine" may refer to a device that performs an operation associated with an industry such as, for example, mining, construction, farming, transportation, or another industry. Moreover, one or more implements may be connected to the machine. As an example, a machine may include a construction vehicle, a work vehicle, or a similar vehicle associated with the industries described above.

FIG. 1 is a diagram of an example machine 100 described herein. As shown in FIG. 1, machine 100 is embodied as a drilling machine, such as a blasthole drilling machine. As shown in FIG. 1, machine 100 may include a frame 105, machinery 110, a mast 115, ground engaging members 120, one or more supporting member 125, and an operator cabin 130.

Frame 105 may be supported on a ground surface by ground engaging members 120. Ground engaging members 120 may propel machine 100, on the ground surface, to a desired location for a drilling operation. Frame 105 may include one or more supporting members 125 for supporting and leveling machine 100 on the ground surface during the drilling operation. Frame 105 may support machinery 110, which may include engines, motors, batteries, pumps, air compressors, a hydraulic fluid source, and/or any other equipment necessary to power and operate drilling machine 100. Frame 105 may further support operator cabin 130, from which an operator may control machine 100.

As shown in FIG. 1, mast 115 may include a mast frame 135 that may support a drill head 140 movably mounted on the mast frame 135. For example, drill head 140 may be operatively coupled to a drill drive assembly and controlled by a hydraulic cylinder 145 (located within mast frame 135) for moving drill head 140 up and down along mast frame 135. Drill head 140 may be coupled to, and may be controllable to rotate, a drill string 150 that includes one or more drill pipes 155. A drill tool, such as a drill bit 160, may be mounted at a bottom end of drill string 150 for drilling into the ground surface. Drill bit 160 may be any type of drill tool, such as a hammer.

As shown in FIG. 1, mast frame 135 may also support a drill pipe rack 165 and a deck wrench 175. Drill pipe rack 165 may store one or more drill components, such as drill pipes 155, in one or more slots 170 to hold and provide the drill components during the drilling operation. Drill pipe rack 165 may be pivotably connected to mast frame 135 such that drill pipe rack 165 may pivot into mast frame 135 for adding or removing drill pipes 155 to drill string 150.

As shown in FIG. 1, machine 100 may include a deck wrench 175, a dust hood 180, a plurality of sensor devices 185, and a controller 190. Deck wrench 175 may be located on a bottom deck (not shown) of mast frame 135. Deck wrench 175 may be configured to engage a portion of drill string 150 during after a drilling operation of machine 100 is completed and during a tramming operation after the drilling operation is completed. A shape of deck wrench 175 may correspond to a shape of the one or more drill pipes 155 of drill string 150, as explained below.

Dust hood 180 may be configured to receive drill bit 160 after drill string 150 is retracted from the ground surface following the drill operation. Dust hood 180 may be configured to prevent dust and other materials, resulting from the drilling operation, from traveling upward toward mast 115 and other components of machine 100.

As shown in FIG. 1, sensor devices 185 may be provided at different positions on components or portions of machine 100. For example, sensor devices 185 may be provided on mast 115, mast frame 135, and/or drill string 150. A sensor device 185 may include one or more devices that are capable of receiving, generating, storing, processing, and/or providing signals indicating a position and orientation of a component, of machine 100, on which the sensor device 185 is provided.

In some instances, a sensor device 185, provided on drill string 150, may provide signals indicating a vertical position of a drilling assembly that includes drill string 150 and/or drill bit 160. The vertical position may indicate whether the drilling assembly is aligned with deck wrench 175. Sensor device 185 may provide the signals periodically (e.g., every twenty milliseconds, every fifty milliseconds, among other examples). Additionally, or alternatively, the sensor device 185 may provide the signals based on a trigger (e.g., based on receiving a request from controller 190).

Controller 190 may include an electronic control module (ECM), a computer vision controller, and/or an autonomy controller, among other examples. Controller 190 may control and/or monitor operations of machine 100 based on signals from sensor devices 185 and/or from operator controls of operator cabin 130, as described in more detail below. For example, controller 190 may be configured to cause deck wrench 175 to engage an engagement portion of drill string 150 based on the vertical position of drill string 150.

For example, controller 190 may determine the vertical position of drill string 150 based on signals from the sensor device 185 provided on drill string 150. Controller 190 may cause deck wrench 175 to engage the engagement portion of drill string 150 based on determining that the vertical position of the drilling assembly corresponds to a deck wrench engaging position, as explained below. In some implementations, machine 100 may be an autonomous drilling machine. In this regard, controller 190 may be further configured to cause machine 100 to autonomously tram from a first location to a second location during a tramming operation.

As indicated above, FIG. 1 is provided as an example. Other examples may differ from what was described in connection with FIG. 1.

Figure 2:
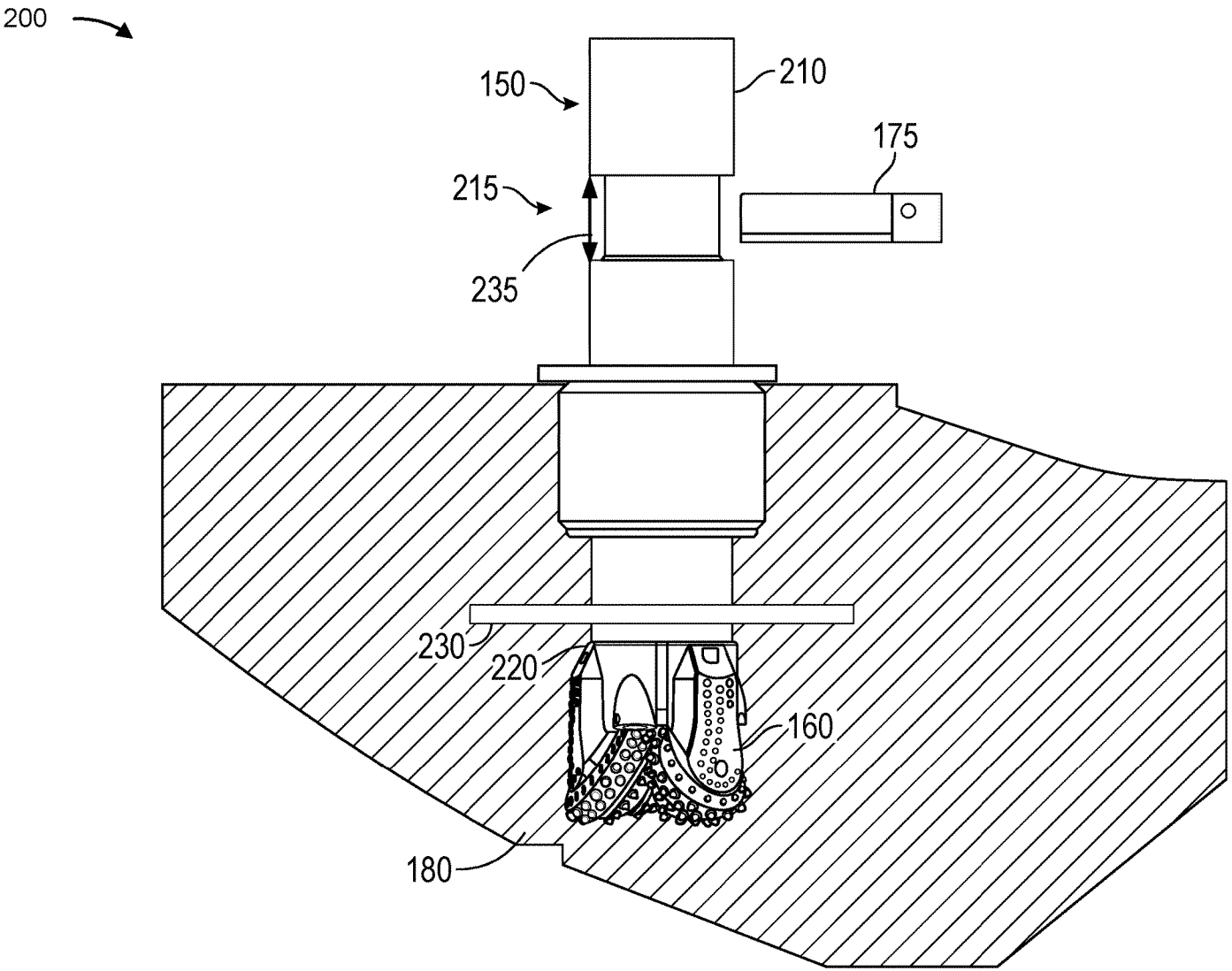
FIG. 2 is a diagram of a cross-section view of a portion of the example machine described herein.

FIG. 2 is a diagram of a cross-section view 200 of a portion of machine 100 described herein. Elements of machine 100 have been described above in connection with FIG. 1. As shown in FIG. 2, drill string 150 includes an adapter 210 connected to drill bit 160. As shown in FIG. 2, adapter 210 includes an engagement portion 215 provided adjacent to a bottom surface 220 of adapter 210. Bottom surface 220 may be provided at an end of adapter 210 (e.g., a bottom end of adapter 210) that is connected drill bit 160.

As shown in FIG. 2, drill bit 160 may be in a stowed state (or stowed position). For example, drill bit 160 may be received by dust hood 180 in the stowed state. In some instances, dust hood 180 may be configured to prevent dust and other materials from traveling upward in conjunction with a seal 230. After machine 100 completes a drilling operation and/or in anticipation of a tramming operation, drill string 150 may be retracted away from a ground surface to cause drill bit 160 to be in the stowed state.

When drill string 150 is retracted in this manner, a vertical position of drill string 150 may correspond to a deck wrench engaging position. In other words, engagement portion 215 may be aligned with deck wrench 175. As shown in FIG. 2, a sufficient amount of clearance (e.g., a sufficient gap) may be provided between a bottom surface of drill bit 160 and dust hood 180). Additionally, or alternatively, as shown in FIG. 2, a sufficient amount of clearance (e.g., a sufficient gap) may be provided between drill bit 160 and seal 230. Such a sufficient amount of clearance may prevent premature wear and/or premature failure of seal 230.

In some instances, a location of engagement portion 215 may be based on a distance from bottom surface 220 of adapter 210 when drill bit 160 is the stowed state. The location of engagement portion 215 may be selected such that engagement portion 215 is aligned with deck wrench 175 when drill bit 160 is the stowed state.

In some implementations, a size of the circumferential groove may be based on a size of deck wrench 175. For example, a diameter of engagement portion 215 (defined by the circumferential groove) may correspond to a diameter of deck wrench 175. Additionally, or alternatively, a width and/or a depth of engagement portion 215 (defined by the circumferential groove) may correspond to a width and/or a depth of deck wrench 175. In other words, the size of engagement portion 215 (defined by the circumferential groove) may correspond to the size of deck wrench 175.

Additionally, or alternatively, a shape of engagement portion 215 (defined by the circumferential groove) may correspond to a shape of deck wrench 175. The size and/or the shape of engagement portion 215 (defined by the circumferential groove) corresponding to the size and/or the shape of deck wrench 175 may facilitate deck wrench 175 engaging engagement portion 215.

As indicated above, FIG. 2 is provided as an example. Other examples may differ from what was described in connection with FIG. 2.

Figure 3:
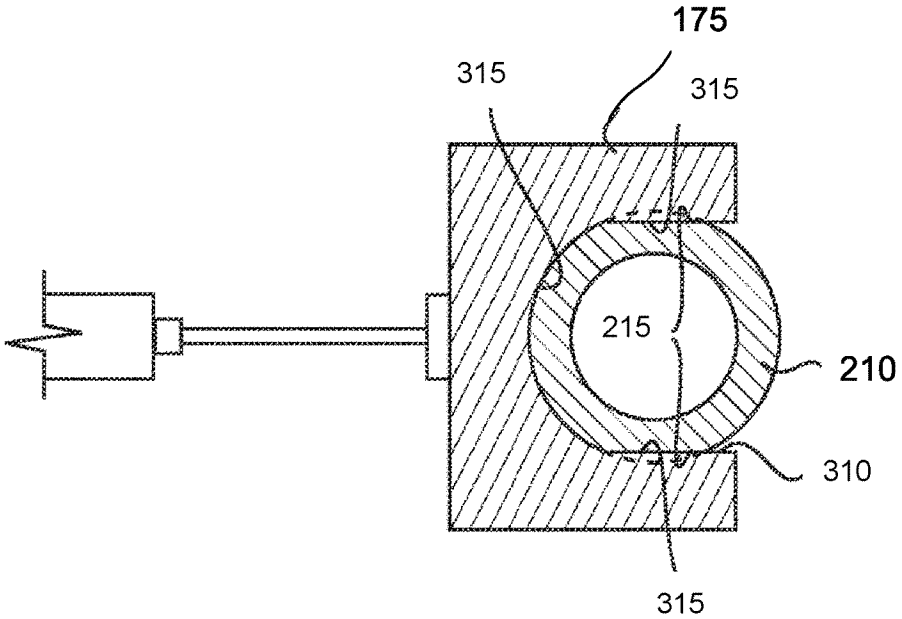
FIG. 3 is a diagram of a top view of a deck wrench described herein.

FIG. 3 is a diagram of a top view 300 of deck wrench 175 described herein. Elements of machine 100 have been described above in connection with FIG. 1. As shown in FIG. 3, deck wrench 175 may include an opening 310 and inner surfaces 315. Deck wrench 175 may receive adapter 210 via opening 310. Inner surfaces 315 may be configured to engage engagement portion 215 of adapter 210.

As indicated above, FIG. 3 is provided as an example. Other examples may differ from what was described in connection with FIG. 3.

Figure 4:
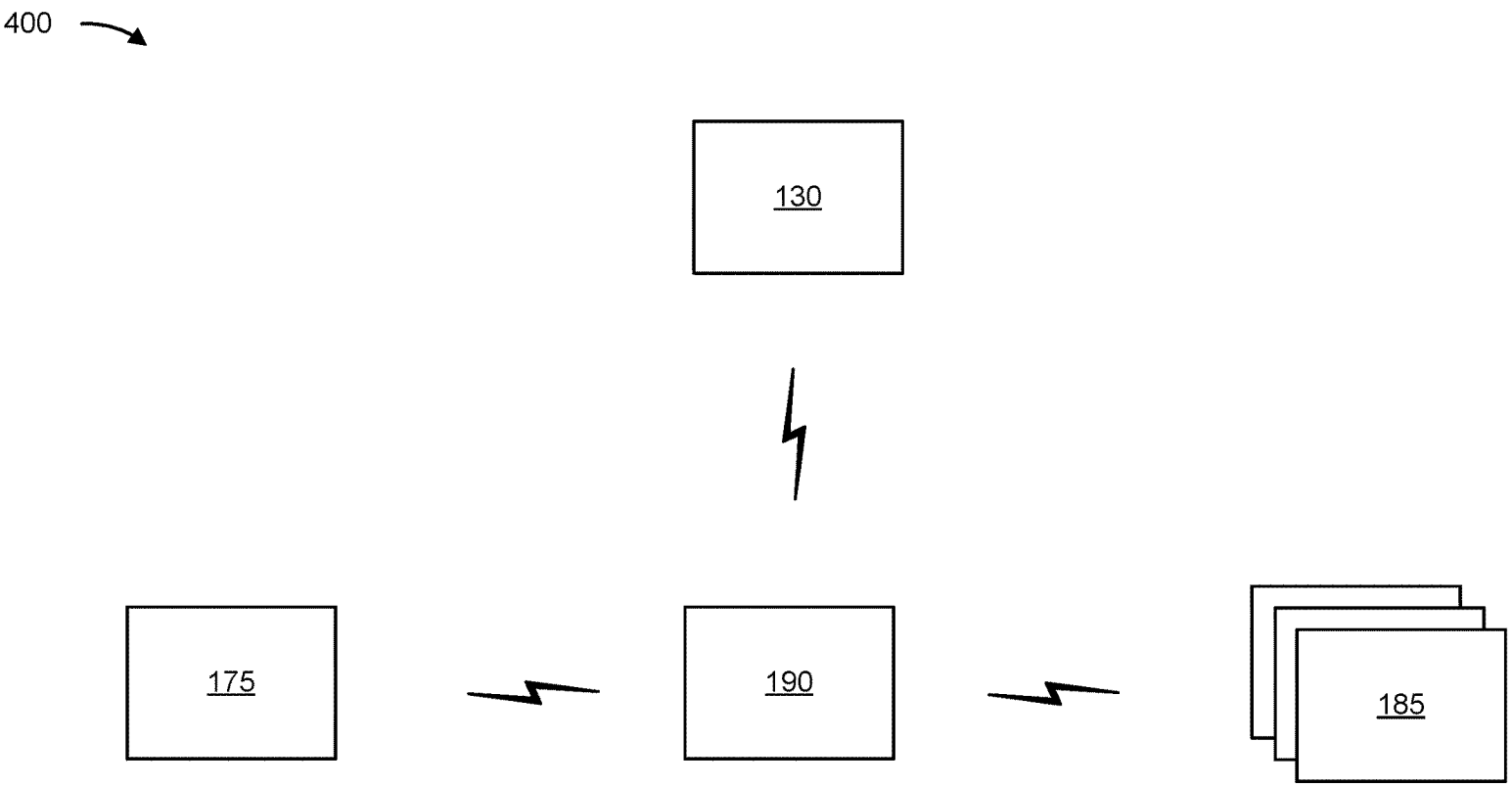
FIG. 4 is a diagram of an example system described herein.

FIG. 4 is a diagram of an example system 400 described herein. As shown in FIG. 4, system 400 includes operator cabin 130, deck wrench 175, sensor devices 185, and controller 190. In some implementations, controller 190 may be configured to determine whether machine 100 has completed a drilling operation at a current location. In some examples, controller 190 may receive signals from one or more operator controls of operator cabin 130. Based on the signals from the one or more operator controls, controller 190 may determine that machine 100 has completed the drilling operation at the current location.

Based on determining that machine 100 has completed the drilling operation at the current location, controller 190 may determine that machine 100 will be initiating a tramming operation to a subsequent location. Alternatively, controller 190 may receive a tramming signal (from the one or more operator controls) indicating that the tramming operation is being initiated.

Based on determining that machine 100 has completed the drilling operation and/or based on determining that machine 100 will be initiating the tramming operation, machine 100 may determine that deck wrench 175 is to engage engagement portion 215 of adapter 210. In some situations, machine 100 may receive sensor data from a sensor device 185 provided on drill string 150. Based on the sensor data, controller 190 may determine a vertical position of a drilling assembly that includes drill string 150 and drill bit 160.

Controller 190 may determine whether the vertical position corresponds to the deck wrench engaging position. For example, controller 190 may determine whether deck wrench 175 is aligned with engagement portion 215 of adapter (e.g., aligned with the circumferential groove on adapter 210). For instance, when one or more sensor devices 185 and controller 190 determine that bottom surface 220 is within a specified range, controller 190 may determine that deck wrench 175 is aligned with engagement portion 215. In some examples, the specific range may be a range 235 as shown in FIG. 2. As an example, the specific range may be 50 mm. In some implementations, a 65 mm thick deck wrench 175 may engage within a 115 mm step down on adapter 210. In some examples, the one or more sensor devices 185 may include a rotary encoder coupled with a series of proximity sensor devices. Additionally, or alternatively, the one or more sensor devices 185 may include a linear displacement sensor device. Additionally, or alternatively, the one or more sensor devices 185 may include a linear potentiometer. Additionally, or alternatively, the one or more sensor devices 185 may include a laser measurement system. In some implementations, controller 190 may compare the vertical position (identified by the sensor data) and the deck wrench engaging position identified by engagement position information. The vertical position may indicate a current distance (or a current height) of bottom surface 220 from a reference point. The reference point may include a ground surface on which machine 100 is located, a bottom surface of ground engaging members 120, a bottom surface of a supporting member 125, a top surface of dust hood 180, among other examples. In other words, the sensor data may indicate the current distance (or the current height) between bottom surface 220 and the reference point.

The engagement position information may identify a particular distance (or a particular height) from the reference point to deck wrench 175. In other words, the deck wrench engaging position may be provided at the particular distance (or the particular height) from the reference point to deck wrench 175. The engagement position information may be stored in a memory associated with controller 190.

When determining that deck wrench 175 is aligned with the circumferential groove on adapter 210, controller 190 may determine the vertical position and a position of engagement portion 215 (e.g., based on the distance from bottom surface 220 of adapter 210 to the location of engagement portion 215, as described above). Controller 190 may compare the position of engagement portion 215 and the deck wrench engaging position. Controller 190 may determine that deck wrench 175 is aligned with the circumferential groove on adapter 210 based on determining that the portion of engagement portion 215 matches (or substantially matches within a tolerance) the deck wrench engaging position.

Based on determining that deck wrench 175 is aligned with the circumferential groove on adapter 210, controller 190 may cause deck wrench 175 to extend and engage the circumferential groove (e.g., engage engagement portion 215). In some instances, controller 190 may receive a signal from the one or more operator controls indicating that drill bit 160 is in the stowed state. In this regard, controller 190 may determine that deck wrench 175 is aligned with the circumferential groove on adapter 210 based on the signal indicating that drill bit 160 is in the stowed state.

In some implementations, after deck wrench 175 engages the circumferential groove on adapter 210, controller may enable machine 100 to perform the tramming operation to tram from the current location to the subsequent location. In some instances, machine 100 may be an autonomous machine. In this regard, controller 190 may cause machine 100 to autonomously perform the tramming operation from the current location to the subsequent location. For example, controller 190 may cause machine 100 to autonomously perform the tramming operation from the current location to the subsequent location based on information identifying the subsequent location (e.g., geographical information identifying the subsequent location).

In some situations, controller 190 may receive additional sensor data from one or more sensor devices 185 after receiving the tramming signal. Controller 190 may determine, based on the additional sensor data, that the vertical position of the drilling assembly is below a bottom of dust hood 180 or below the deck wrench engaging position. Accordingly, controller 190 may suspend the tramming operation based on determining that the vertical position of the drilling assembly is below a bottom of dust hood 180 or below the deck wrench engaging position.

In some instances, controller 190 may receive from the one or more operator controls a drilling signal indicating that a drilling operation is being initiated (e.g., at the subsequent location). In this regard, machine 100 may cause deck wrench 175 to be disengaged from engagement portion 215 based on the drilling signal.

While the foregoing examples have been described with respect to preventing drifting of a drill string (e.g., drill string 150) of a machine (e.g., machine 100) during a tramming operation of the machine, implementations described herein prevent drifting of the drill string when the machine has been shutoff. For example, implementations described herein prevent drifting of the drill string during a shift change or overnight.

The number and arrangement of devices shown in FIG. 4 are provided as an example. In practice, there may be additional devices, fewer devices, different devices, or differently arranged devices than those shown in FIG. 4. Furthermore, two or more devices shown in FIG. 4 may be implemented within a single device, or a single device shown in FIG. 4 may be implemented as multiple, distributed devices. Additionally, or alternatively, a set of devices (e.g., one or more devices) of the example component may perform one or more functions described as being performed by another set of devices of the example component.

Figure 5:
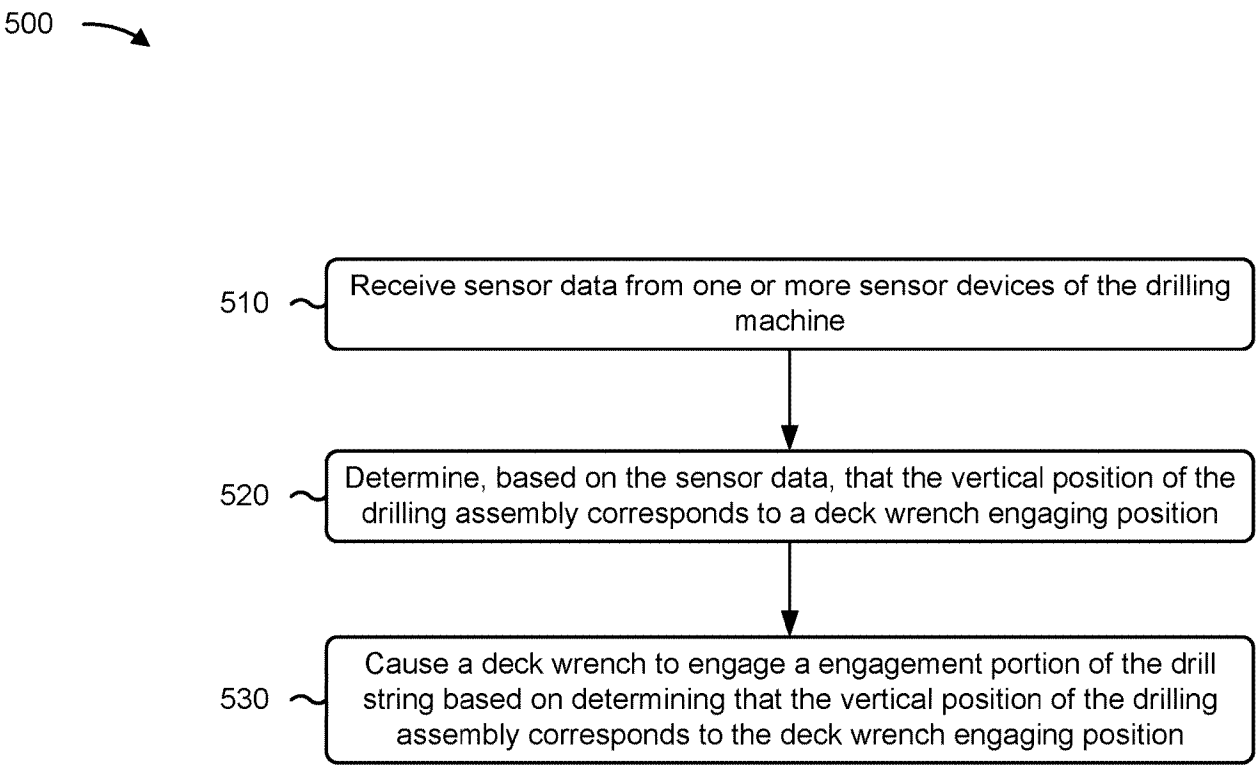
FIG. 5 is a flowchart of an example processes relating to automatic deck wrench engagement for drilling machines.

FIG. 5 is a flowchart of an example process 500 relating to automatic deck wrench engagement for drilling machines. In some implementations, one or more process blocks of FIG. 5 may be performed by a controller (e.g., controller 190). In some implementations, one or more process blocks of FIG. 5 may be performed by another device or a group of devices separate from or including the controller, such as a deck wrench (e.g., deck wrench 175) and/or one or more sensor devices (e.g., sensor devices 185).

As shown in FIG. 5, process 500 may include receiving sensor data from one or more sensor devices of the drilling machine, wherein the sensor data indicates a vertical position of a drilling assembly of the drilling machine, and wherein the drilling assembly includes a drill string connected to a drill bit (block 510). For example, the controller may receive sensor data from one or more sensor devices of the drilling machine, wherein the sensor data indicates a vertical position of a drilling assembly of the drilling machine, and wherein the drilling assembly includes a drill string connected to a drill bit, as described above. In some implementations, the sensor data indicates a vertical position of a drilling assembly of the drilling machine. In some implementations, the drilling assembly includes a drill string connected to a drill bit.

As further shown in FIG. 5, process 500 may include determining, based on the sensor data, that the vertical position of the drilling assembly corresponds to a deck wrench engaging position (block 520). For example, the controller may determine, based on the sensor data, that the vertical position of the drilling assembly corresponds to a deck wrench engaging position, as described above.

As further shown in FIG. 5, process 500 may include causing a deck wrench, of the drilling machine, to engage an engagement portion of the drill string based on determining that the vertical position of the drilling assembly corresponds to the deck wrench engaging position, wherein the engagement portion of the drill string is adjacent to an end of the drill string connected to the drill bit (block 530). For example, the controller may cause a deck wrench, of the drilling machine, to engage an engagement portion of the drill string based on determining that the vertical position of the drilling assembly corresponds to the deck wrench engaging position, wherein the engagement portion of the drill string is adjacent to an end of the drill string connected to the drill bit, as described above. In some implementations, the engagement portion of the drill string is adjacent to an end of the drill string connected to the drill bit.

Process 500 may include additional implementations, such as any single implementation or any combination of implementations described below and/or in connection with one or more other processes described elsewhere herein.

In a first implementation, causing the deck wrench to engage the engagement portion of the drill string comprises receiving a tramming signal indicating that a tramming operation is being initiated, determining a position of a mast of the drilling machine based on additional sensor data from the one or more sensor devices, and causing the deck wrench to engage the engagement portion of the drill string further based on the tramming signal and the position of the mast.

In a second implementation, the drilling machine is an autonomous drilling machine, and wherein the method further comprises causing the autonomous drilling machine to autonomously tram from a first location to a second location during the tramming operation.

In a third implementation, causing the deck wrench to engage the engagement portion of the drill string comprises receiving a drilling signal indicating that a drilling operation has been completed, and causing the deck wrench to engage the engagement portion of the drill string further based on the drilling signal.

In a fourth implementation, the engagement portion of the drill string includes a circumferential groove on an adapter of the drill string, and wherein causing the deck to engage the engagement portion of the drill string comprises causing the deck wrench to engage the circumferential groove on the adapter.

In a fifth implementation, determining that the vertical position of the drilling assembly corresponds to the deck wrench engaging position comprises determining that the deck wrench is aligned with the circumferential groove on the adapter.

Although FIG. 5 shows example blocks of process 500, in some implementations, process 500 may include additional blocks, fewer blocks, different blocks, or differently arranged blocks than those depicted in FIG. 5. Additionally, or alternatively, two or more of the blocks of process 500 may be performed in parallel.

INDUSTRIAL APPLICABILITY

Implementations described are directed to preventing drifting of a drill string of a drilling machine during a tramming operation of the drilling machine. For example, implementations described herein are directed to causing a deck wrench of the drilling machine to extend and engage an engagement portion of the drill string during the tramming operation.

By engaging the engagement portion of the drill string in this manner, implementations described herein may prevent the drill string from drifting toward the ground surface during the tramming operation occurring after the drilling operation is completed. In this regard, the deck wrench may provide support to the drill string and a mast structure of the drilling machine during the tramming operation. The mast structure may be in a horizontal orientation (or horizontal position) or may be in a vertical orientation (or vertical position).

Accordingly, the deck wrench may prevent premature wear and/or premature failure of the drill string and the mast structure. Additionally, by engaging the engagement portion of the drill string in this manner, implementations described herein may prevent unexpected and undesired downtime during the tramming operation of the drilling machine.

The foregoing disclosure provides illustration and description, but is not intended to be exhaustive or to limit the implementations to the precise forms disclosed. Modifications and variations may be made in light of the above disclosure or may be acquired from practice of the implementations. Furthermore, any of the implementations described herein may be combined unless the foregoing disclosure expressly provides a reason that one or more implementations cannot be combined. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

As used herein, "a," "an," and a "set" are intended to include one or more items, and may be used interchangeably with "one or more." Further, as used herein, the article "the" is intended to include one or more items referenced in connection with the article "the" and may be used interchangeably with "the one or more." Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of"). Further, spatially relative terms, such as "below," "lower," "above," "upper," and the like, may be used herein for ease of description to describe one element or feature's relationship to another element(s) or feature(s) as illustrated in the figures. The spatially relative terms are intended to encompass different orientations of the apparatus, device, and/or element in use or operation in addition to the orientation depicted in the figures. The apparatus may be otherwise oriented (rotated 90 degrees or at other orientations) and the spatially relative descriptors used herein may likewise be interpreted accordingly.

What is claimed is:

1. A system for controlling drilling operations, the system comprising:

one or more sensor devices configured to generate sensor data indicating a vertical position of a drilling assembly of a drilling machine, wherein the drilling assembly includes a drill string connected to a drill bit; and a controller, of the drilling machine, configured to:

receive the sensor data;

determine that the vertical position of the drilling assembly corresponds to a deck wrench engaging position based on one or more of:

the sensor data indicating that a bottom surface of an adapter of the drill string is within a specified range of a deck wrench of the drilling machine, the sensor data indicating a current distance or height between the bottom surface and a reference point that includes one of a ground surface on which the drilling machine is located, a bottom surface of ground engaging members of the drilling machine, a bottom surface of a supporting member of the drilling machine, or a dust hood of the drilling machine, engagement position information that identifies a particular distance or height from the reference point to the deck wrench, or a distance from the bottom surface to a location of the deck wrench engaging position; and cause the deck wrench to engage an engagement portion of the drill string based on determining that the vertical position of the drilling assembly corresponds to the deck wrench engaging position, wherein the engagement portion of the drill string is adjacent to an end of the drill string connected to the drill bit.

2. The system of claim 1, wherein the engagement portion of the drill string includes a circumferential groove on the adapter, and wherein, to cause the deck wrench to engage the engagement portion of the drill string, the controller is configured to:

cause the deck wrench to engage with the circumferential groove on the adapter.

3. The system of claim 2, wherein, to determine that the vertical position of the drilling assembly corresponds to the deck wrench engaging position, the controller is configured to:

determine that the deck wrench is aligned with the circumferential groove on the adapter.

4. The system of claim 1, wherein, to cause the deck wrench to engage the engagement portion of the drill string, the controller is configured to:

determine that the drill bit is in a stowed state; and cause the deck wrench to engage the engagement portion of the drill string further based on determining that the drill bit is the stowed state.

5. The system of claim 1, wherein the deck wrench engaging position is based on a distance from the bottom surface of the adapter of the drill bit when the drill bit is in a stowed state.

6. The system of claim 1, wherein the controller is configured to:

receive a drilling signal indicating that a drilling operation is being initiated; and cause the deck wrench to be disengaged from the engagement portion of the drill string based on the drilling signal.

7. The system of claim 1, wherein, to cause the deck wrench to engage the engagement portion of the drill string, the controller is configured to:

receive a tramming signal indicating that a tramming operation is being initiated; and cause the deck wrench to engage the engagement portion of the drill string based on the tramming signal.

8. The system of claim 7, wherein the controller is further configured to:

receive additional sensor data from the one or more sensor devices after receiving the tramming signal;

determine, based on the additional sensor data, that the vertical position of the drilling assembly is below a bottom of the dust hood of the drilling machine; and suspend the tramming operation based on determining that the vertical position of the drilling assembly is below the bottom of the dust hood of the drilling machine.

9. A method performed by a controller of a drilling machine, the method comprising:

receiving sensor data from one or more sensor devices of the drilling machine, wherein the sensor data indicates a vertical position of a drilling assembly of the drilling machine, and wherein the drilling assembly includes a drill string connected to a drill bit;

determining that the vertical position of the drilling assembly corresponds to a deck wrench engaging position based on one or more of:

the sensor data indicating that a bottom surface of an adapter of the drill string is within a specified range of a deck wrench, the sensor data indicating a current distance or height between the bottom surface and a reference point that includes one of a ground surface on which the drilling machine is located, a bottom surface of ground engaging members of the drilling machine, a bottom surface of a supporting member of the drilling machine, or a dust hood of the drilling machine, engagement position information that identifies a particular distance or height from the reference point to the deck wrench, or a distance from the bottom surface to a location of the deck wrench engaging position; and causing the deck wrench to engage an engagement portion of the drill string based on determining that the vertical position of the drilling assembly corresponds to the deck wrench engaging position, wherein the engagement portion of the drill string is adjacent to an end of the drill string connected to the drill bit.

10. The method of claim 9, wherein causing the deck wrench to engage the engagement portion of the drill string comprises:

receiving a tramming signal indicating that a tramming operation is being initiated;

determining a position of a mast of the drilling machine based on additional sensor data from the one or more sensor devices; and causing the deck wrench to engage the engagement portion of the drill string further based on the tramming signal and the position of the mast.

11. The method of claim 10, wherein the drilling machine is an autonomous drilling machine, and wherein the method further comprises:

causing the autonomous drilling machine to autonomously tram from a first location to a second location during the tramming operation.

12. The method of claim 9, wherein causing the deck wrench to engage the engagement portion of the drill string comprises:

receiving a drilling signal indicating that a drilling operation has been completed; and causing the deck wrench to engage the engagement portion of the drill string further based on the drilling signal.

13. The method of claim 9, wherein the engagement portion of the drill string includes a circumferential groove on the adapter, and wherein causing the deck wrench to engage the engagement portion of the drill string comprises:

causing the deck wrench to engage the circumferential groove on the adapter.

14. The method of claim 13, wherein determining that the vertical position of the drilling assembly corresponds to the deck wrench engaging position comprises:

determining that the deck wrench is aligned with the circumferential groove on the adapter.

15. A drilling machine, comprising:

a frame;

a deck wrench supported by the frame;

a mast supported by the frame; and a drill string supported by the mast, wherein the drill string includes an adapter configured to be connected to a drill bit, wherein the adapter includes a circumferential groove, and wherein the deck wrench is configured to automatically engage the circumferential groove based on one or more of:

sensor data indicating that a bottom surface of the adapter is within a specified range of the deck wrench, the sensor data indicating a current distance or height between the bottom surface and a reference point that includes one of a ground surface on which the drilling machine is located, a bottom surface of ground engaging members of the drilling machine, a bottom surface of a supporting member of the drilling machine, or a dust hood of the drilling machine, engagement position information that identifies a particular distance or height from the reference point to the deck wrench, or a distance from the bottom surface to a location of a deck wrench engaging position.

16. The drilling machine of claim 15, wherein the deck wrench is configured to be disengaged from the circumferential groove based on a drilling operation being initiated.

17. The drilling machine of claim 15, wherein the deck wrench is configured to automatically engage the circumferential groove based on the bottom surface of the adapter being within the specified range of the deck wrench.

18. The drilling machine of claim 15, wherein a size of the circumferential groove is based on a size of the deck wrench.

19. The drilling machine of claim 15, wherein the circumferential groove is adjacent to an end of the adapter that connects to the drill bit.

20. The drilling machine of claim 15, further comprising:

a controller configured to:

receive one or more signals regarding one or more operations of the drilling machine; and cause the deck wrench to engage the circumferential groove or to be disengaged from the circumferential groove based on the one or more signals.

* * * * *